US012522928B2

(12) United States Patent
Prestowitz et al.

(10) Patent No.: US 12,522,928 B2
(45) Date of Patent: Jan. 13, 2026

(54) METHODS FOR TREATING METAL NANOCRYSTALS AND FOR FORMING BULK NANOSTRUCTURED METAL ALLOYS

(71) Applicant: Northwestern University, Evanston, IL (US)

(72) Inventors: Luke Clyde Oak Prestowitz, Evanston, IL (US); Jiaxing Huang, Wilmette, IL (US); David C. Dunand, Evanston, IL (US)

(73) Assignee: Northwestern University, Evanston, IL (US)

( * ) Notice: Subject to any disclaimer, the term of this patent is extended or adjusted under 35 U.S.C. 154(b) by 706 days.

(21) Appl. No.: 17/903,339

(22) Filed: Sep. 6, 2022

(65) Prior Publication Data

US 2023/0083886 A1 Mar. 16, 2023

Related U.S. Application Data

(60) Provisional application No. 63/241,147, filed on Sep. 7, 2021.

(51) Int. Cl.

| | |
|---|---|
| ***C23C 18/00*** | (2006.01) |
| ***B22F 1/17*** | (2022.01) |
| ***C22C 1/04*** | (2023.01) |
| ***C23C 18/16*** | (2006.01) |
| ***C23C 18/40*** | (2006.01) |

(52) U.S. Cl.

CPC ..... *C23C 18/405* (2013.01); *B22F 1/17* (2022.01); *C22C 1/0466* (2013.01); *C23C 18/1637* (2013.01); *B22F 2301/10* (2013.01); *B22F 2301/255* (2013.01)

(58) Field of Classification Search

CPC ..... C23C 18/405; C23C 18/1637; B22F 1/17; B22F 2301/10; B22F 2301/255; C22C 1/0466

USPC ..... 106/1.23

See application file for complete search history.

(56) References Cited

U.S. PATENT DOCUMENTS

2016/0293288 A1 10/2016 Hu et al.

OTHER PUBLICATIONS

Bang et al., "Advances in protective layer-coating on metal nanowires with enhanced stability and their applications", Applied Material Today, 22 (2021) (Year: 2021).*

Bang et al., "Adavnces in Protective Layer-Coating on Metal Nanowires with Enhanced Stability and their Applications.", Applied Material Today, 22 (2021). (Year: 2021).*

(Continued)

*Primary Examiner* — James E McDonough

(74) *Attorney, Agent, or Firm* — Bell & Manning, LLC

(57) ABSTRACT

Methods of treating metal nanocrystals are provided. In embodiments, such a method comprises exposing metal nanocrystals comprising a metal and characterized by at least one twinning boundary therein, to a plating solution comprising a reducing agent and coating metal cations comprising a different metal, under conditions to form a coating of the different metal on surfaces of the metal nanocrystals via electroless deposition by chemical reduction of the coating metal cations, thereby providing coated metal nanocrystals. Methods of forming bulk nanostructured metal alloys from the coated metal nanocrystals are also provided.

10 Claims, 10 Drawing Sheets

(56) References Cited

OTHER PUBLICATIONS

Jiayan Luo et al., "Bulk Nanostructured Materials Based on Two-Dimensional Building Blocks: A Roadmap," *ACS Nano* Sep. 21, 2015, vol. 9, No. 10; p. 9432-9436.
Junhyuk Bang et al., "Advances in protective layer-coating on metal nanowires with enhanced stability and their applications," *Applied Materials Today* (2021) vol. 22; 100909; pp. 1-19. https://doi.org/10.1026/i.apmt.2020.100909.

* cited by examiner

FIG. 2D
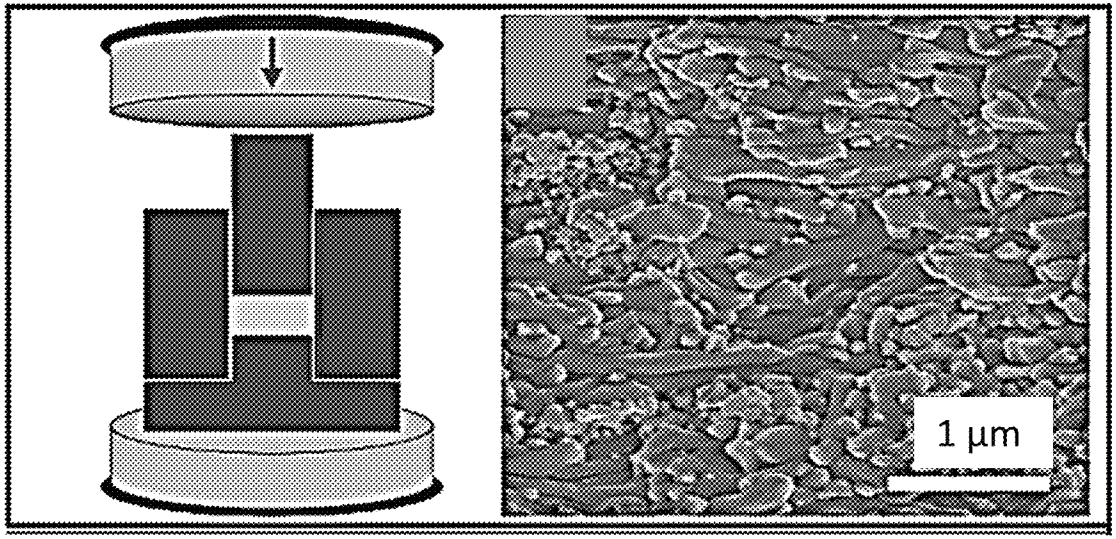
FIG. 2C
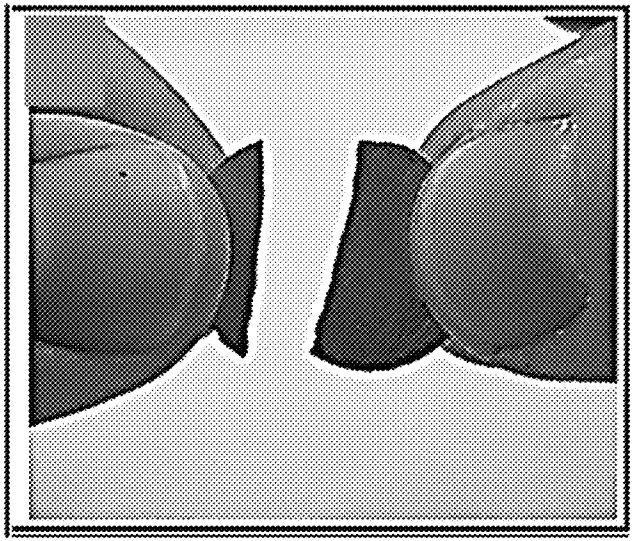
FIG. 2E

FIG. 2G
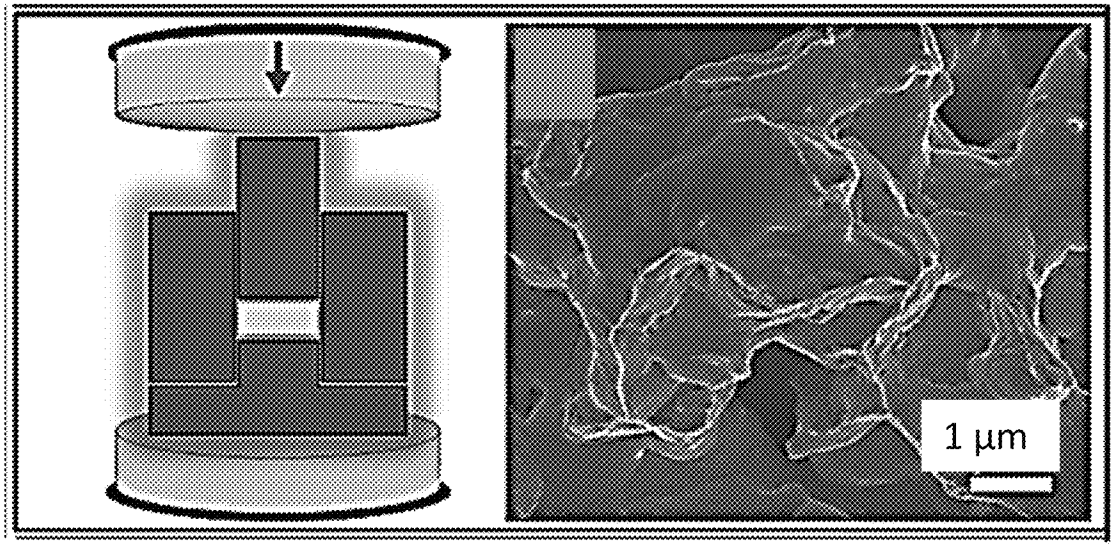
FIG. 2F
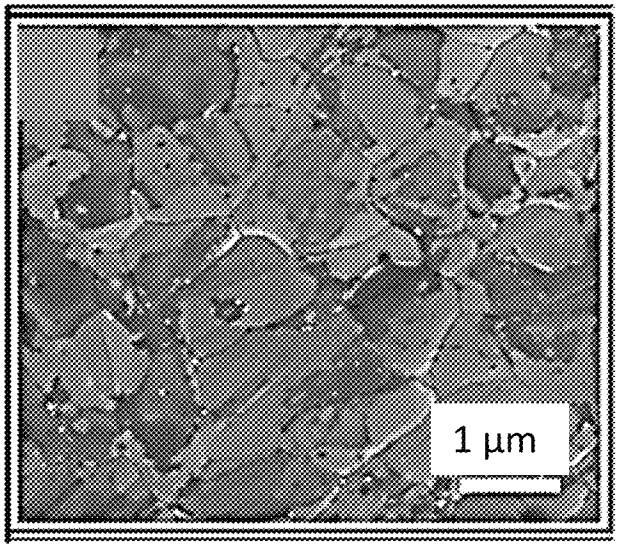
FIG. 2H

FIG. 2J
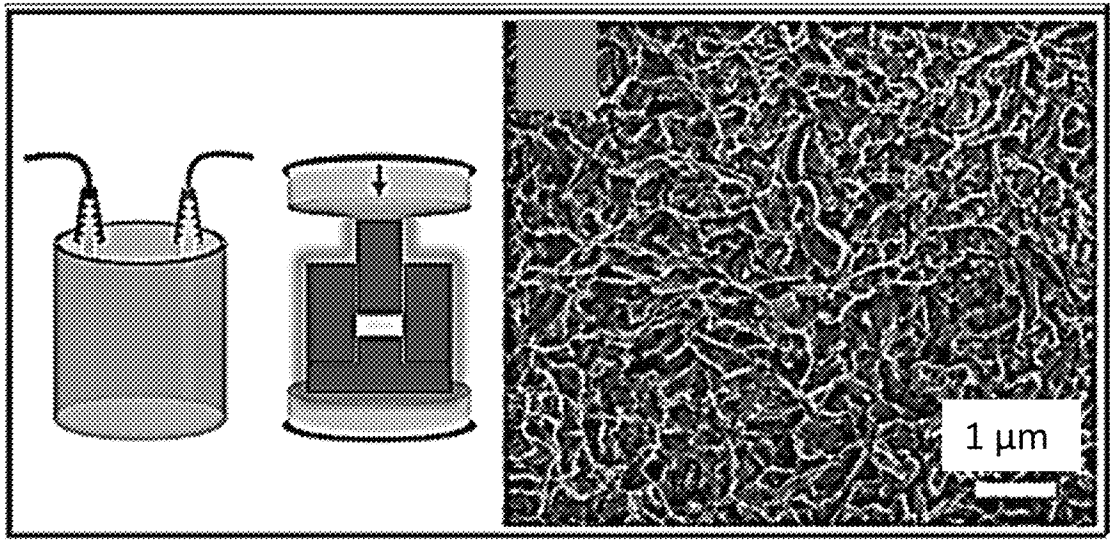
FIG. 2I
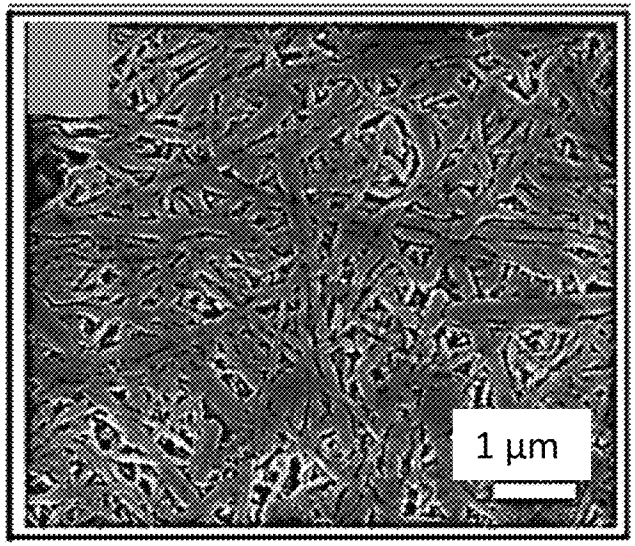
FIG. 2K

METHODS FOR TREATING METAL NANOCRYSTALS AND FOR FORMING BULK NANOSTRUCTURED METAL ALLOYS

CROSS-REFERENCE TO RELATED APPLICATIONS

The present application claims priority to U.S. provisional patent application No. 63/241,147 that was filed Sep. 7, 2021, the entire contents of which are incorporated herein by reference.

REFERENCE TO GOVERNMENT RIGHTS

This invention was made with government support under DMR-1747776 awarded by the NSF. The government has certain rights in the invention.

BACKGROUND

Silver nanowires, which are highly conductive, have a high aspect ratio, and small diameters, are a great candidate material to make transparent conductors (TCs) or conductive films for heaters. A large hurdle to using silver nanowires in these respective products is their low thermal stability, meaning that temperatures far below half the melting point of silver will greatly alter nanowire morphology, including causing the nanowires to ball up. This ruins their use in transparent conductors where the processing temperatures can destroy the nanowires. For nanowire heaters, the problem is the same, limiting the range of temperatures the heaters can be used for, and thereby limiting applications.

SUMMARY

Provided herein are methods for treating metal nanocrystals, including silver nanowires. The methods enhance the thermal stability of the metal nanocrystals, allowing the metal nanocrystals to withstand high temperatures, e.g., up to 400° C., with minimal or no change in morphology. Also provided are methods for forming bulk nanostructured metal from the treated metal nanocrystals.

In one aspect, methods of treating metal nanocrystals are provided. In embodiments, such a method comprises exposing metal nanocrystals comprising a metal and characterized by at least one twinning boundary therein, to a plating solution comprising a reducing agent and coating metal cations comprising a different metal, under conditions to form a coating of the different metal on surfaces of the metal nanocrystals via electroless deposition by chemical reduction of the coating metal cations, thereby providing coated metal nanocrystals.

In another aspect, methods of forming bulk nanostructured metal alloys are provided. In embodiments, such a method comprises applying pressure to a collection of coated metal nanocrystals while heating, wherein the coated metal nanocrystals comprise metal nanocrystals comprising a metal and characterized by at least one twinning boundary therein, and a coating of a different metal on surfaces of the metal nanocrystals, and wherein the bulk nanostructured metal alloy comprises the metal of the metal nanocrystals and the different metal of the coating, the bulk nanostructured metal alloy characterized by the at least one twinning boundary therein.

In another aspect, bulk nanostructured metal alloys are provided. In embodiments, a bulk nanostructured silver-copper alloy comprises silver, copper, and at least one embedded silver nanowire, the bulk nanostructured silver-copper alloy characterized by at least one twinning boundary therein.

Other principal features and advantages of the disclosure will become apparent to those skilled in the art upon review of the following drawings, the detailed description, and the appended claims.

BRIEF DESCRIPTION OF THE DRAWINGS

Illustrative embodiments of the disclosure will hereafter be described with reference to the accompanying drawings.

FIG. 1A is typically achieved by severe plastic deformation. FIG. 1B represents densification of metal particles, such as penta-twinned silver nanowires (indicated by the cross-sectional views) in to yield new microstructures in the final bulk metal that are characteristic of the building blocks but difficult to achieve through the process of FIG. 1A. The grain size in FIG. 1A can be reduced down to the range of micron to sub-micron scale, while the diameter of the nanoparticles or nanowires in FIG. 1B is typically smaller than ~100 nm.

FIG. 2C demonstrates cold pressing of the silver nanowire filter cake that led to a densified pellet (FIG. 2D) that easily fractured (FIG. 2E). FIG. 2F demonstrates hot pressing of the cold pressed filter cake at 190° C. for 8 h, leading to a tougher silver pellet, but with coarsened grains due to the sintering of the nanowires (FIGS. 2G and 2H). FIG. 2I demonstrates electrodeposition of copper onto the silver nanowire filter cake, followed by hot pressing at 190° C. for 8 h. However, the wire morphology was only retained on the surface of the pellet (FIG. 2K) but not inside (FIG. 2J), indicating that electrodeposition of copper did not penetrate the filter cake, leaving many nanowires uncoated.

DETAILED DESCRIPTION

Figure 1A:
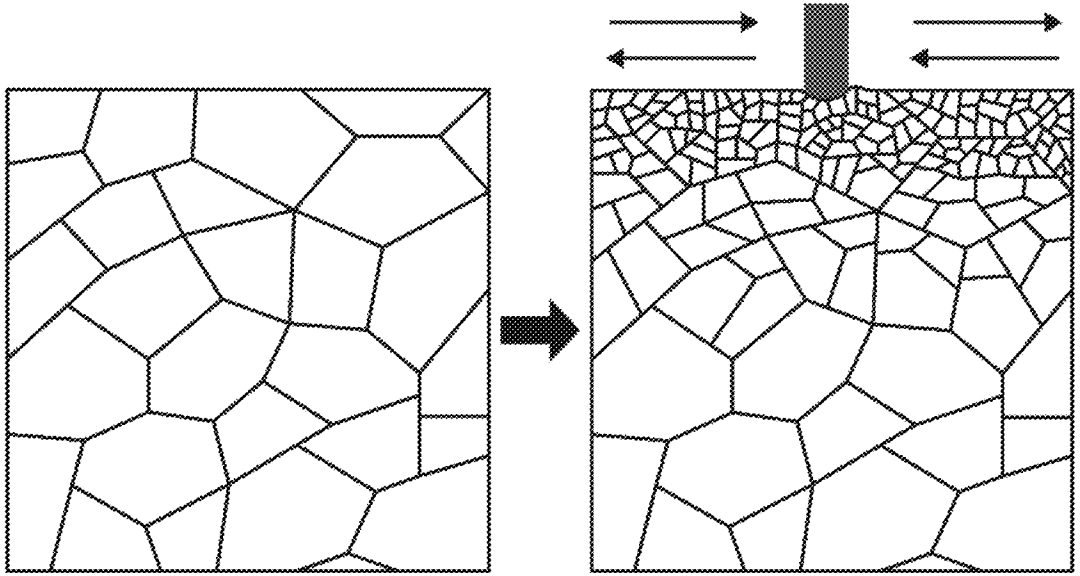
FIG. 1A is a schematic illustration of a top-down approach to forming bulk nanostructured metals.

Much of the description in the present disclosure is illustrated using copper treated silver nanowires. However, it is understood that the present disclosure encompasses the use of other coating metals besides copper and other metal nanocrystals besides silver nanowires.

Provided are methods of treating silver nanowires. In embodiments, such a method comprises coating surfaces of silver nanowires with a different (i.e., not silver) metal via electroless deposition. The metal to be used to coat the silver nanowire surfaces may referred to herein as a "coating metal." The silver nanowires are elongated, one-dimensional metal nanocrystals characterized by one or more twinning boundaries. Each silver nanowire generally has five such twinning boundaries. (See FIG. 1B.) As described below, such crystal twinning within the silver nanowires is a morphological feature that is useful for providing bulk nanostructured silver with enhanced properties since at least some crystal twinning is preserved in the bulk nanostructured silver. Silver nanowires may be characterized by their dimensions, with two of the dimensions being nanoscale, e.g., 250 nm or less, and of similar magnitude. The nanoscale dimensions may be referred to as a diameter, although this is not intended to imply that the cross-sections are perfectly circular. For example, the cross-section of a silver nanowire is generally that of a pentagon due to the five-fold symmetry of the twinning boundaries. The diameter may be 200 nm or less, 100 nm or less, 90 nm or less, 80 nm or less, or in the range of from 1 nm to 100 nm, from 10 nm to 80 nm, or from 25 nm to 75 nm. The other dimension of the silver nanowires, which may be referred to as a length, is generally much greater than the diameter so that the silver nanowires have relatively high aspect ratios, e.g., at least 10, 50, or 100. The length may be, e.g., at least 1 μm, at least 5 μm, at least 10 μm, or in a range of from 1 μm to 50 μm. The silver nanowires may be composed of pure silver, although this doesn't preclude the existence of impurities present due to the process used to synthesize the silver nanowires (e.g., a polyol process as illustrated in the Example, below). In such embodiments, the silver nanowires may be described as consisting of silver. Any of the dimensions above may be an average dimension as determined using the techniques described in the Example, below.

As noted above, the present disclosure may encompass the use of other metals for the metal nanocrystals (e.g., copper, iron) as well as other shapes and sizes for the metal nanocrystals (e.g., nanoparticles, nanoplatelets). However, generally, the composition and morphology are such that at least one of the dimensions is nanoscale and the metal nanocrystal is characterized by the one or more twinning boundaries. Combinations of different types (different compositions and/or morphologies) of metal nanocrystals may be used.

Regarding nanoplatelets, these refer to nanocrystals having one dimension being nanoscale with the other two dimensions being substantially greater, e.g., about 25 times greater, about 50 times greater, about 100 times greater, about 200 times greater, etc. These other two dimensions may also be of similar magnitude to each other as described above with respect to nanowires. The nanoscale dimension of a nanoplatelet may be referred to a thickness, which may be 100 nm or less, 50 nm or less, 25 nm or less, 10 nm or less, 5 nm or less, or in a range of from 1 nm to 50 nm or from 1 nm to 25 nm. These values may be average values as described above with respect to nanowires. The other dimensions of the nanoplatelets may be referred to as a length and a width, but these terms are not meant to imply that the nanoplatelets are limited to square or rectangular shapes. Other shapes, including irregular shapes may be used.

Regarding nanoparticles, these refer to nanocrystals having all three dimensions being nanoscale. These three dimensions are of similar magnitude to each other. Nanoparticles may be characterized by a diameter, although this is not intended to imply that the cross-sections are perfectly circular as described above with respect to nanowires. The diameter may be 200 nm or less, 100 nm or less, 90 nm or less, 80 nm or less, or in the range of from 1 nm to 100 nm, from 10 nm to 80 nm, or from 25 nm to 75 nm. These values may be average values as described above with respect to nanowires.

The coating metal used to coat the surfaces of the silver nanowires is of a different composition, in this embodiment, not silver. Suitable coating metals will generally be immiscible with silver (or in other embodiments, the metal of the metal nanocrystals) and have a relatively high surface diffusion coefficient. In embodiments, the coating metal has a solubility of 0.1% to 2% in the metal of the metal nanocrystals. This may refer to solubility at particular temperature, e.g., the temperature used during the present methods such as a temperature of 200° C., 300° C., 400° C., or in a range of from 150° C. to 500° C. In embodiments, the coating metal has a surface diffusion coefficient of at least $10^{-8}$ $cm^2/s$, at least $10^{-9}$ $cm^2/s$, or $10^{-10}$ $cm^2/s$. Again, this may refer to surface diffusion at a particular temperature (see the temperatures described above with respect to solubility. In embodiments, the coating metal comprises copper. In embodiments, the copper is pure copper (i.e., free of other components, although impurities may be present). In such embodiments, the coating metal may be described as consisting of copper. Other coating metals include nickel, silver, cobalt. However, coating metals such as gold, platinum, iridium, rhodium, palladium, and osmium are generally not used. Thus, the present treated metal nanocrystals may be described as being free of such metals, i.e., not comprising such metals.

The electroless deposition may be carried out by exposing the silver nanowires to a plating solution under conditions to result in a conformal coating of the coating metal on the outer surfaces of the silver nanowires via the chemical reduction of coating metal cations in the plating solution. Electroless deposition does not require an externally generated electric current to be used to form the coating. In electroless deposition, the metal of the metal nanocrystals is generally not oxidized. Suitable plating solutions comprise a source of the coating metal cations (e.g., copper cations) such as a metal salt; a reducing agent (e.g., formaldehyde); and a liquid medium (e.g., water, an aqueous solution, or an ionic liquid). Various conditions may be used to optimize formation and thickness of the conformal coating, including use of, or absence of, additives in the plating solution, relative amounts of components in the plating solution, mixing conditions (e.g., type of mixing, speed of mixing), and period of time. Illustrative plating solutions and conditions are described in the Example, below. It is noted, however, it has been found that the enhancement in thermal stability is sensitive to the amount of the coating metal. For copper coated silver nanowires, it is useful to use from 0.2 weight % to 15 weight % copper. This includes from 0.3 weight % to 12 weight % copper, from 0.5 weight % to 10 weight % copper, from 1 weight % to 8 weight % copper. Here, weight % refers to the total amount of copper as compared to the total weight of the alloy, i.e., the copper and the silver.

Figure 2B:
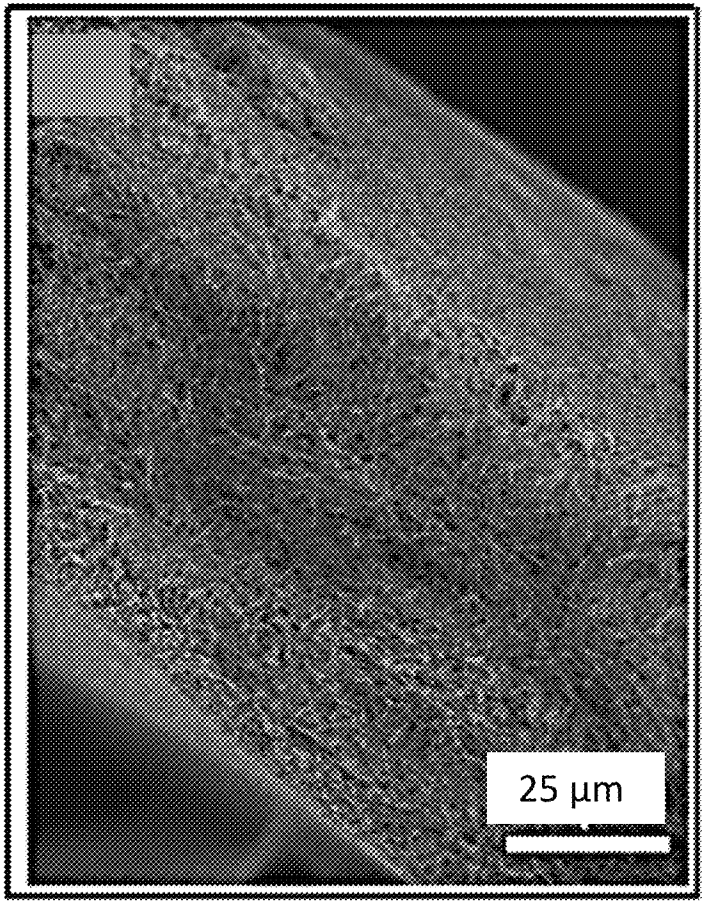
FIG. 2A is an SEM image of silver nanowires synthesized by polyol route and FIG. 2B is a cross-sectional view of the resulting filter cake after filtration.

The copper coated silver nanowires may be recovered from the plating solution, e.g., via filtration, and if desired, redispersed in a suitable liquid (e.g., an organic solvent such as ethanol). If filtered, the copper coated silver nanowires may be referred to as a "filter cake." In this form, the copper coated silver nanowires are generally randomly oriented with respect to one another with nanowires contacting one another at one or more contact points to form a porous network. (See FIG. 2D showing a SEM image of cross-section of a filter cake of uncoated silver nanowires, but a filter cake of coated silver nanowires would exhibit a similar image). (See also FIG. 3A.)

It is noted that the treatment method described above encompasses exposing individual silver nanowires to the plating solution (e.g., by dispersing the nanowires into the plating solution) as well as exposing a filter cake of uncoated silver nanowires (also referred to herein as a "green body") to the plating solution, e.g., by immersion, dipping, etc.

Figures 3A, 3B, 3C, 3D:
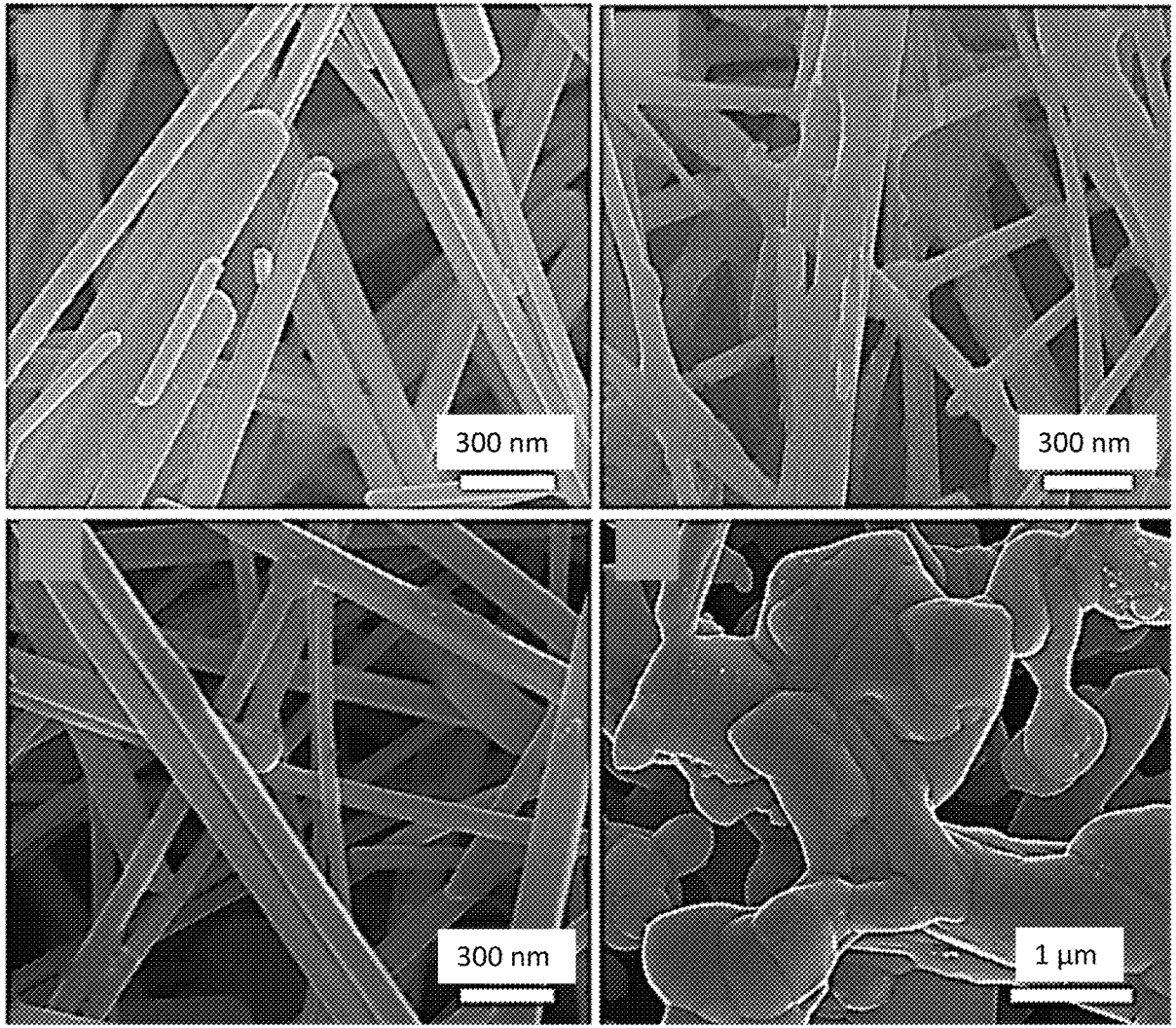
FIG. 3A is an SEM image of copper coated silver nanowires before annealing and FIG. 3B is an SEM image of the copper coated silver nanowires after being annealed at 390° C. for 2 hours. The results shows that electroless deposition of copper on suspended colloidal silver nanowires allows uniform reaction to occur on individual wires, leading to a uniform copper coating. The coated nanowires maintain their morphology even after being annealed. By contrast, FIG. 3C (showing uncoated silver nanowires before annealing) and FIG. 3D (showing uncoated silver nanowires after annealing) show that the nanowire morphology is destroyed by annealing under the same condition.

Illustrative copper coated silver nanowires are shown in FIGS. 3A-3B. As described in the Example, below, EDS mapping in STEM mode images were obtained to confirm that the copper is present as a thin, conformal, uniform coating on outer surfaces of the silver nanowires. The conformal copper coating enhances the thermal stability of the silver nanowires by preventing or minimizing sintering of individual silver nanowires to one another at elevated temperatures. Here, "sintering" encompasses the loss of shape of individual silver nanowires and coalescence of silver nanowires to one another, e.g., due to Plateau-Rayleigh instability and recrystallization. The enhanced thermal stability is evidenced by comparing FIGS. 3B and 3D. These images show copper coated (FIG. 3B) and uncoated (FIG. 3D) silver nanowires after being annealed in air at 390° C. for two hours. Sintering has destroyed the morphology of the uncoated silver nanowires, while the shape and dimensions of the copper coated silver nanowires remain largely intact. This can be quantified by comparing the average diameter of copper coated silver nanowires prior to annealing (e.g., see FIG. 3A) to the average diameter of copper coated silver nanowires after heating at 390° C. in air for two hours (e.g., see FIG. 3B). In embodiments, the copper coated silver nanowires are characterized by an average diameter that changes by no more than 1% to 5% after heating at 390° C. in air for two hours. This includes by no more than 1% to 4% and from 1% to 3%.

The copper coated silver nanowires may be used in any application in which silver nanowires are otherwise used. Illustrative applications include as conductive elements/films for transparent conductors and heaters.

Also provided are methods of forming bulk nanostructured silver using the treated silver nanowires described above. In embodiments, such a method comprises applying pressure to the treated silver nanowires for a period of time. The pressure is generally applied with heating in which case this step of the method may be referred to as "hot pressing." Various pressures, temperatures, and times may be used. As demonstrated in the Example below, a pressure of 45 MPa, a temperature of 390° C., and a time of 15 minutes was sufficient to transform treated silver nanowires (see FIG. 3A) to bulk nanostructured silver (FIGS. 4A-4D). However, in general, suitable pressures include those of from 40 MPa to 1000 MPa; suitable temperatures include those of from 350° C. to 410° C.; and suitable times include those from 5 to 60 minutes. Regarding the temperature, a temperature in a range of from greater than room temperature (e.g., 100° C., 200° C., 300° C.) to no more than 50% of the melting temperature of the coating metal may be used. Any desired amount of treated silver nanowires may be used, depending upon the desired amount of and use for the bulk nanostructured silver.

The resulting bulk nanostructured silver is a solid metal alloy composed of silver and copper. However, one or more twinning boundaries are present therein. These twinning boundaries are derived from the twinning boundaries of the original silver nanowires, at least some of which are maintained even during hot pressing due to the enhanced thermal stability afforded by the copper coating. The preservation of these twinning boundaries was a surprising and unexpected result revealed during the experimentation described in the Example below. The existence of twinning boundaries may be confirmed using high magnification BF-STEM images as described in the Example, below. (See FIG. 4D). The bulk nanostructured silver may also comprise one or more silver nanowires (or portions thereof) embedded within the solid metal alloy. These silver nanowires correspond to those of the original silver nanowires. The existence of such silver nanowires may be confirmed using SEM images as described in the Example, below. (See FIG. 4B). The relative amount of the silver and copper in the bulk nanostructured silver depends upon the relative amounts used during treatment of the silver nanowires. Illustrative amounts include, e.g., from 2 weight % to 15 weight % copper, from 4 weight % to 12 weight % copper, and from 5 weight % to 10 weight % copper (all referring to the total amount of copper as compared to the total weight of the solid metal alloy). The balance is silver. The bulk nanostructured silver may be a pure silver-copper alloy and free of any other materials or additives, although this doesn't preclude the existence of impurities present due to the processes used to form the bulk nanostructured silver as described herein. In such embodiments, the bulk nanostructured silver may be described as consisting of silver and copper.

The bulk nanostructured silver may be characterized by properties such as its density and microhardness. Due to the existence of the twinning boundaries, such properties are different from those exhibited by a comparative bulk silver product formed using untreated silver nanowires. By "comparative bulk silver product" it is meant that the materials and methods used to form the product are the same as used to form the bulk nanostructured silver except that the silver nanowires are not treated to form copper coated silver nanowires. Regarding density, this may be measured according to the equation described in the Example, below. The density of the bulk nanostructured silver may be in a range from 9 g/cm$^3$ to 10.4 g/cm$^3$.

Figure 4B:
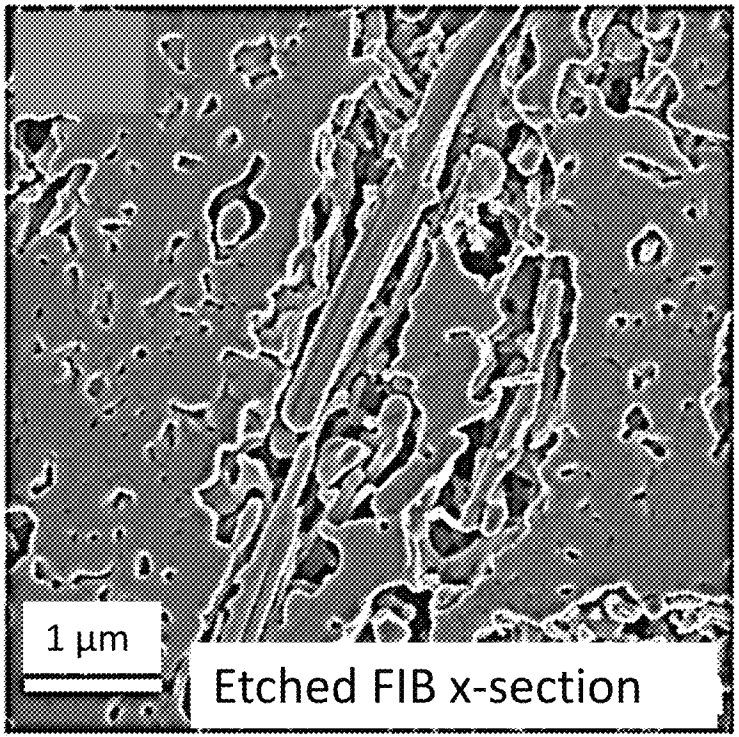
FIG. 4B is an SEM image after preferential etching of copper, revealing some embedded nanowires.

Regarding microhardness, this may be measured using the technique described in the Example, below. As demonstrated in FIG. 4E, the microhardness of the bulk nanostructured silver is significantly greater than that of a comparative bulk silver product. This includes at least 4 times greater, at least 5 times greater, and at least 6 times greater. In embodiments, the microhardness of the bulk nanostructured silver is at least 1200 MPa, at least 1400 MPa, at least 1600 MPa, or at least 3 GPa. Further regarding microhardness, the bulk nanostructured silver may be characterized by a relatively sharp drop in microhardness observed during an isothermal annealing step (e.g., isothermal annealing at 500° C. under inert atmosphere for at least 10 hours). This sharp drop may be a loss of microhardness by a factor of 1.5 or 2 over a time of about 9 hours. This is demonstrated for an illustrative bulk nanostructured silver in FIG. 4F and further described in the Example below. This sharp drop, which is not present in the comparative bulk silver product, is further evidence of the existence of twinning boundaries in the bulk nanostructured silver.

As noted above, if other metal nanocrystals and/or other coating metals are used, other corresponding types of bulk nanostructured metals may be formed using the methods described above. Some illustrative examples include (1) nickel coated silver nanocrystals to form bulk nanostructured silver; (2) silver coated copper nanocrystals to form bulk nanostructured copper; (3) cobalt coated copper nanocrystals to form bulk nanostructured copper; (4) silver coated iron nanocrystals to form bulk nanostructured iron; and (5) copper coated iron nanocrystals to form bulk nanostructured iron. In each of embodiments (1)-(5), the nanocrystals may be nanowires or nanoplatelets or combinations thereof. As noted above, however, generally the nanocrystals are characterized by one or more twinning boundaries.

In embodiment (1), the nickel coated silver nanocrystals may be described as consisting of nickel and silver to form bulk nanostructured silver consisting of nickel and silver. In embodiment (2), the silver coated copper nanocrystals may be described as consisting of silver and copper to form bulk nanostructured copper consisting of silver and copper. In embodiment (3), the cobalt coated copper nanocrystals may be described as consisting of cobalt and copper to form bulk nanostructured copper consisting of cobalt and copper. In embodiment (4), the silver coated iron nanocrystals may be described as consisting of silver and iron to form bulk nanostructured iron consisting of silver and iron. In embodiment (5), the copper coated iron nanocrystals may be described as consisting of copper and iron to form bulk nanostructured iron consisting of copper and iron.

EXAMPLE

Introduction

Figure 1B:
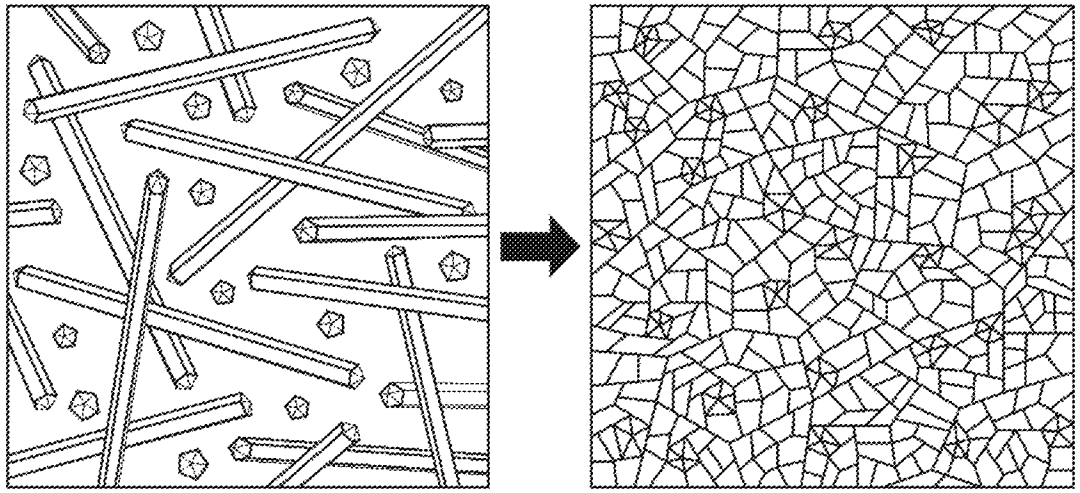
FIG. 1B is a schematic illustration of a bottom-up approach.

Two branches of nanomaterials research have been growing, largely independently, in the past few decades. Taking metallic materials as an example, the first branch focuses on bulk and dense forms of metals with microstructures (e.g., size of grains, subgrains and twinning) at the nanoscale, where the structure-properties relationship is controlled by the interplay of dislocation networks, grain boundaries and nano-twinning which determine their mechanical properties. Bulk nanostructured metals are typically made by "top-down" processing using severe plastic deformation (FIG. 1A). "Bottom-up" techniques—such as vacuum-based deposition, electroplating or consolidation of ultrafine particles—have also been used to make thin films. The other branch of metal nanomaterial research focuses on the structure—property relationship of isolated nanoscale entities typically made by chemical synthesis. New "collective" electronic, optical and ionic properties, in a relatively bulk form of the materials, may also emerge from assemblies of nanoparticles of various morphologies. With the rapid advancement in scalable chemical synthesis, an abundant collection of metal nanocrystals with controllable size, shape, chemical composition, and internal microstructure (e.g., twinning) are now available. It is very interesting to explore the construction of bulk nanostructured metals using these well-defined nanocrystals with internal twinning (FIG. 1B). This bottom-up approach represents a different synthesis strategy, where well-defined, uniquely twinned "clustered grains" are first synthesized individually "atom-by-atom", and then assembled "grain-by-grain" to obtain a bulk metal. This contrasts with bulk nanostructured metals prepared by plastic deformation or controlled metal deposition, where the formation of grains and twinning structures occurs simultaneously, which is also convoluted with grain alignment during crystal growth. It potentially provides several new degrees of freedom for manipulating grains and nanotwins before their consolidation into a bulk structure, providing additional control over novel microstructures and thus, properties.

In this Example, silver nanowires synthesized from the classical polyol route were used to construct bulk nanostructured silver. Such nanowires have five-fold twinning planes along their axis, and are frequently used as a small-sized model system for studying the mechanical properties of bulk metals. Once synthesized, these independent nanowire "grains" were utilized as building blocks to assemble a bulk material "grain-by-grain". Although it was expected that these long wires would be shortened and severely deformed during densification to form the bulk material, it was unexpectedly observed that a large fraction of the fragmented grains still contained the multiply-twinned structure. This allowed a densified, cohesive material to be obtained without eliminating these twin boundaries that were native to the starting nanowires, providing bulk silver with unique microstructures.

Figure 2A:
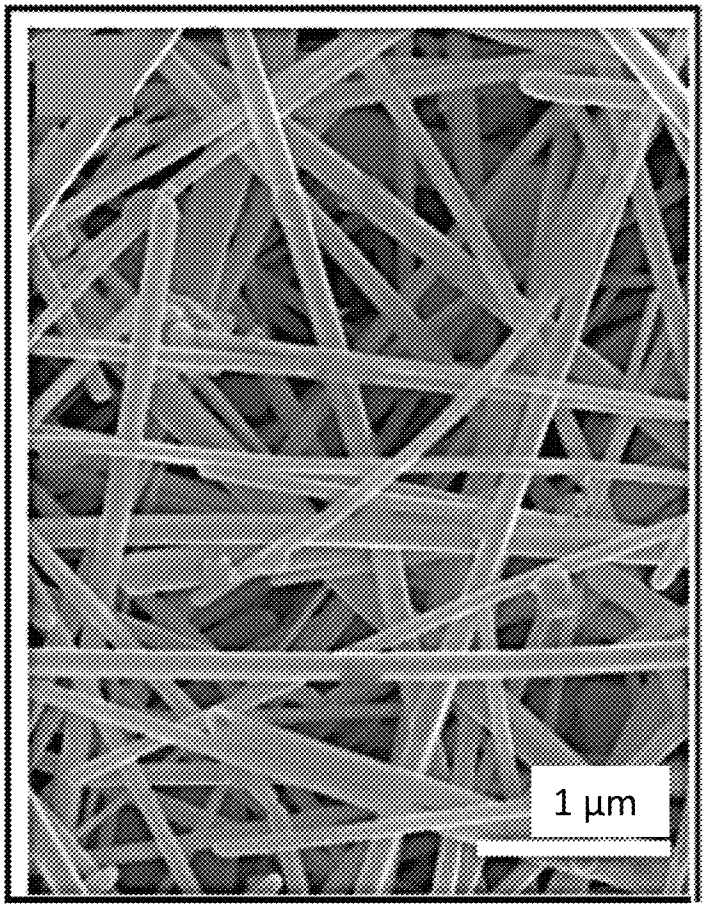

Silver nanowires were prepared based on a modified polyol synthesis in which silver nitrate was reduced in a hot polyvinylpyrrolidone (PVP) solution in ethylene glycol in the presence of sodium chloride. The diameter of the nanowires ranged from 70-140 nm and their length was in the range of 5-20 μm. Once cleaned and purified, the nanowires (FIG. 2A) were collected by vacuum filtration to form a filter cake (FIG. 2B), which was used as the starting green body for various densification techniques.

Experimental Section

Materials: For nanowire synthesis, polyvinylpyrrolidone (PVP) (55,000 MW) was purchased from Millipore Sigma. Ethylene glycol (EG), silver nitrate ($AgNO_3$), sodium chloride (NaCl), sodium borohydride ($NaBH_4$), copper sulfate ($CuSO_4$), formaldehyde (37% aqueous), ethanol, and potassium sodium tartrate (Rochelle salt) were purchased from Fisher Scientific. All chemicals were used as received.

Synthesis of silver nanowires: A stock solution of PVP (0.45 M) and NaCl (1.07 mM) in EG (80 mL) was made by stirring overnight. EG (40 mL) and $AgNO_3$ (50 mM) were dissolved in a 250 ml glass round bottom boiling flask at room temperature using a stir bar. The glass bulb was then transferred to an oil bath set to 120° C. with the stir bar at 1000 rpm. To this, the PVP/NaCl solution was dropwise added into the bulb within 10 minutes. After addition, the oil bath was set to 160° C. and a condenser attached to a water chiller. The reaction was then run for 60 minutes before removal from the oil bath.

Synthesis of silver particles: A solution of PVP (0.67 g) in EG (10 mL) was made by stirring until the PVP was dissolved. Another solution with $AgNO_3$ (0.85 g) was dissolved in EG (10 mL). A glass bulb with (60 mL EG) was placed in an oil bath set to 160° C. with the stir bar at 250 rpm. The PVP and $AgNO_3$ solution were mixed and placed into a 20 mL syringe, which was placed into an automatic pump and added into the bulb in 10 minutes. After addition, a condenser attached to a water chiller was placed over the bulb opening. The reaction was then run for 60 minutes before removal from the oil bath. Particle mean diameter was 226 nm based on ImageJ analysis of SEM micrographs of the as synthesized particles.

PVP removal: The nanowire filter cake collected by vacuum filtration (25 mm polycarbonate membrane with 1 μm pores) was submersed into a solution of $NaBH_4$(0.5 M) in a mixed solvent of ethanol (50 mL) and DI water (50 mL) for 30 seconds. The cleaned filter cake was then rinsed with DI water.

Electrodeposition of copper: A copper cyanide solution (15 g/L CuCN, 28 g/L NaCN, and 15 g/L $Na_2CO_3$) in DI water was used for copper electrodeposition. A galvanostatic pulse plating profile was used for deposition (Nova 2, Metraohm Autolab, on cycle 100 ms at a current of 600 mA and an off cycle of 1 s at 0 mA, giving a duty cycle of 9%). The cycle was repeated 300 times.

Electroless deposition of copper: Dispersed nanowires or particles (100 mL of 10 mg/mL) were added into the electroless copper plating solution (1.8 g $CuSO_4$, 25 g Rochelle Salt, and 5 g NaOH in 900 mL of DI water). To this was added formaldehyde solution (32 mL) to initiate copper reduction, and the flask was covered by parafilm and placed in the bath sonicator for 30 minutes. Upon completion of reduction, the nanowires or particles were collected via vacuum filtration and rinsed with DI water.

Cold pressing: Purified silver nanowire filter cakes, of both pure and electrodeposited copper coated nanowires, where placed into a die (19 mm inner diameter) and pressed uniaxially (310 MPa for 5 minutes).

Hot pressing: Filter cake films were pressed (air at 190° C.) between two polished stainless-steel plates (40 MPa for 8 hours). For pellets, a graphite paper sheath was placed inside the graphite die (1 cm inner diameter), silver nanowire or commercial silver powders (silver powder, spherical, 0.6-2 micron, 99.9% (metals basis), Alfa Aesar™) were then added to the die and separated by 3 graphite paper punches and a graphite spacer. The graphite die was placed within an induction coil and the hot press chamber was sealed and evacuated (mechanical pump). The samples where then pressed (45 MPa at 390° C. for 15 minutes). The heat was turned off and the die cooled for 1 hour prior to removal.

Isothermal anneal: The annealing was done at 500° C. in a tube furnace with a quartz tube under flowing ultra-high purity argon. Pieces of the same particle- and nanowire-hot-pressed sample, (cut using an Accutom 5 precision saw), were set into 4 groups. The grouped samples were annealed separately for 1, 3, 9, and 27 hours. Each sample was annealed in an alumina crucible with a house covering and baffle made of titanium foil to scavenge residual oxygen in the argon.

Sample polishing: All silver pellets made by the hot-pressing method and isothermal anneal where polished for hardness testing. The samples were embedded in quick setting epoxy and polished (Buehler Automet polisher with 240, 400, 600, 800, and 1200 grit paper). This was followed by polishing using 1 μm alumina and 0.05 μm alumina particle dispersions. Samples, for which a polished cross-section was needed for SEM imaging, were first cut in half using a rotary tool with a metal cut-off wheel, then the above polish process was used followed by a focused ion beam milling step (Leica TIC3X). The samples were held in a liquid nitrogen cooled stage at −70° C. and milled for 3 hours at a gun voltage of 7 kV.

Density measurement: All sample densities were measured (Mettler Toledo) using the Archimedes principle using following relation.

$$\rho = \frac{A}{A-B}(\rho_o - \rho_l) + \rho_l$$

where A is the weight of the pellet in air, B the weight of the pellet in water, $\rho_o$ the density of the water at the measured temperature, and $\rho_l$ the density of air.

Hardness measurement: Hardness measurements were obtained using a Duramin 5 hardness tester set to a 100 g load for 10 s, and the Vickers hardness calculated using the system software.

Structural and chemical characterizations: The general structural features are characterized using 'which SEM and which imaging mode (secondary electrons or backscattered electrons)'. The electron transparent samples were prepared using the focus ion milling (FIB) technique. At the final stage, a very low voltage (5 kV) was used to remove any accumulated damage generated during the previous high voltage milling process. High spatial structural and chemical characterizations were performed on the ARM 200CF microscope operated at 200 kV. This microscope is equipped with a cold field mission gun and dual silicon drift detectors (SDDs). The convergence angle for scanning transmission electron microscopy (STEM) imaging is around 22 mrad. The collection angle of the annual bright field (ABF) imaging ranges from 11 mrad to 22 mrad. The detector size for single SDD was 100 $mm^2$ and the solid angle for the whole collection system was about 1.7 sr.

X-ray fluorescence: ED-XRF was used to obtain a spectrum from the hot-pressed samples and analyzed using software (Spectra-X v 1.6.4 by Crossroads Scientific).

Extended Discussion of Isothermal Anneal Experiments:

The isothermal annealing experiments were used to induce grain growth. For the coated-particle sample, grain growth will result in a drop in hardness, however, large changes in its microstructure are not expected. On the other hand, the coated-nanowire sample exhibits five-fold twinned structure in the final hot-pressed sample. If these wire-like grains grow during isothermal annealing, it is very likely that this grain growth will cause the removal of the nano-twinned structure originating from the preserved nanowire sections. Removal of these sub-grain strengthening boundaries will cause a substantial drop in hardness if they are present at a high density in the sample. To estimate the expected contribution to hardness of the five-fold twinning microstructure the modified Hall-Petch equation was used:

$$\sigma_{flow} = \sigma_o + \frac{k_{GB}}{\sqrt{d}} + \frac{k_{TB}}{\sqrt{\lambda}} \quad (1)$$

where d is the grain size and l the twin boundary spacing, and where the flow stress $\sigma_{flow}$ is converted from hardness by multiplying by a factor of 3. The Hall-Petch parameters $k_{GB}$, $k_{TB}$, and $\sigma_o$ are listed in Table 1, and were obtained from Ke, X. et al., *Nat. Mater.* 2019, 18, 1207-1214.

TABLE 1

Hall-Petch equation parameters for silver with copper microalloying.

| $\sigma_0$ (GPa) | $k_{GB}\left(\mathrm{GPa} * \mathrm{nm}^{\frac{1}{2}}\right)$ | $k_{TB}\left(\mathrm{GPa} * \mathrm{nm}^{\frac{1}{2}}\right)$ |
|---|---|---|
| 0.09 | 3.4 | 1.08 |

The grain size and twin boundary spacing for the nanowires was estimated using the average diameter of the nanowires, which is ~70±30 nm. Each nanowire has twin boundaries in a five-fold symmetry that forms 5 triangles on the pentagonal cross section of the wire. The area of the triangle was estimated and converted into an effective diameter divided by the cos (35°) by using an equivalent area of a circle to get a conservative estimate for the average twin spacing λ. The grain size d, was estimated using 3 times the twin boundary spacing (t=0 hr) or the diameter of the nanowire divided by cos (35°), which is the angle between the (111) slip planes and the axial growth plane of the nanowire (110) (t=27 hr).

In the case where the twinning is no longer present (27-hour isothermal anneal), the Hall-Petch equation simplifies to its original form:

$$\sigma_{flow} = \sigma_o + \frac{k_{GB}}{\sqrt{d}} \tag{2}$$

When these values for grain size and twin boundary spacing are used in the Hall-Petch equation, the range of drop in hardness between nano-twinning presence and absence is consistent with that observed from the isothermal annealing experiment.

Results and Discussion

Four densification techniques were attempted on the green bodies made from the filter cakes. First, the filter cake was uniaxially cold pressed at a pressure up to 310 MPa, which is limited by the yield stress of the stainless-steel die used in this Example. (FIG. 2C.) This generated a free-standing, visibly dense and shiny silver film, which was, however, brittle. Fractographic observation using scanning electron microscopy (SEM) showed intergranular type of fracture. Many long wire-like grains were still visible, indicating insufficient densification and poor cohesion between the grains. (FIG. 2D.) Brittle fracture upon mild bending showed limited cohesion of the nanowire "grains". (FIG. 2E.) In the second approach, the filter cake was first cold pressed at 310 MPa, and then transferred to a hot press where it was further densified at 190° C. and 40 MPa (FIG. 2F). A minimum of 8 hours of hot pressing was needed to produce a sample sufficiently tough to sustain gentle bending. However, this led to complete sintering of the nanowires and significant grain growth, as observed by SEM due to the low thermal stability of the multiply-twinned nanowires. (FIGS. 2G and 2H.) The obstacles to densifying the nanowire products through direct pressing at ambient or elevated temperature are linked to their highly anisotropic geometry, which makes obtaining a high green body density difficult, requiring substantially higher pressures than can be reached by typical cold or hot pressing.

So as to reduce porosity in the green body before compression and to facilitate densification, copper electroplating of the silver nanowire green bodies before densification was used. (FIG. 2I.) Copper was used as it has low miscibility with silver, a high surface diffusion coefficient, and is amenable to electrodeposition. In this third approach, the silver nanowire green body was, at first, electroplated using the copper electroplating solution from the damascene process; however, the additives used in this process interfered with the deposition of copper. Consequently, a copper cyanide strike solution was used with a pulse plating cycle, and the plated green body was then hot pressed at the same conditions used in FIG. 2F. However, copper plating only occurred at the surface of the filter cake and did not penetrate its volume. The samples observed in the SEM after annealing revealed that the copper-coated wires at the surface showed little morphological change. (FIG. 2K.) In contrast, the uncoated wires in the core of the filter cake were sintered. (FIG. 2J.) Thus, the copper-coating formed using these processes did not stabilize the wire-like building blocks or the twinning microstructures while densifying at high temperature.

The fourth and final approach relied on electroless deposition of copper. As noted above, electrodeposition did not achieve a uniform coating of the wires. By contrast, electroless deposition avoids preferred metallic deposition at sharp features, where field lines converge under electrodeposition conditions. This allows for conformally coating of substrates independent of geometry. In addition, electroless deposition utilizes the colloidal stability of nanowires and coats individual wires simultaneously with a conformal layer of copper. This conformal layer was confirmed by element mapping analysis. Specifically, EDS mapping in STEM mode confirmed that electroless deposited copper conformally coated the silver nanowires. Additionally, the dispersion of the uncoated nanowires within the solution was maintained even after copper coating, allowing the coated wires to be uniformly reassembled by filtration.

With the nanowires uniformly coated by copper, the outcome on the enhanced thermal stability of the nanowires was clearly observed: FIG. 3A shows the coated nanowires before annealing and FIG. 3B shows the coated nanowires after annealing in argon at 390° C. for 2 hours. By contrast, FIG. 3C shows the uncoated nanowires before annealing and FIG. 3D shows the uncoated nanowires after annealing in argon at 390° C. for 2 hours. The comparison shows that for the copper-coated wires, the wire shape is preserved. In contrast, the uncoated silver wires have coalesced and lost their shape through Plateau-Rayleigh instability and recrystallization. As further described below, this thermal stability, resulting from the copper coating, then allows hot pressing of the nanowires near half the melting temperature of copper, ensuring that diffusion and sintering can occur together.

Figure 4A:
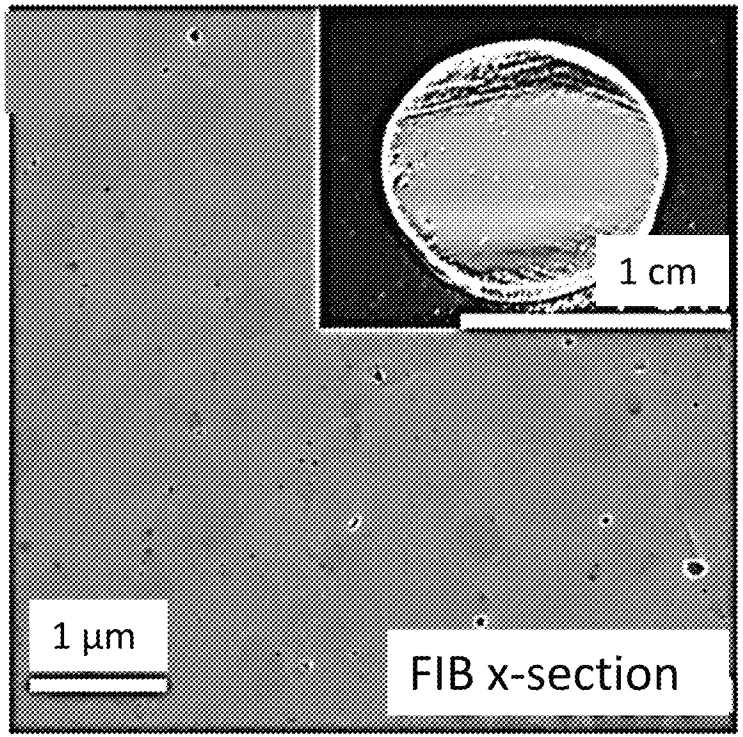
FIG. 4A shows an SEM image showing the dense cross-section of a copper coated silver nanowire pellet (inset photo), prepared by FIB milling.

The copper-plated silver nanowire powder was hot-pressed at 390° C. for 15 minutes, in an argon atmosphere, under a pressure of 45 MPa. These conditions resulted in cohesive pellets (such as shown in the inset of FIG. 4A, 2.2 mm thick) with densities in the range of 9.7-10 g $cm^{-3}$. The pellet consists of 6-11 wt. % copper and 89-94 wt. % silver, based on energy dispersive X-ray fluorescence measurements, i.e., 92-97% of theoretical density.

Figure 4D:
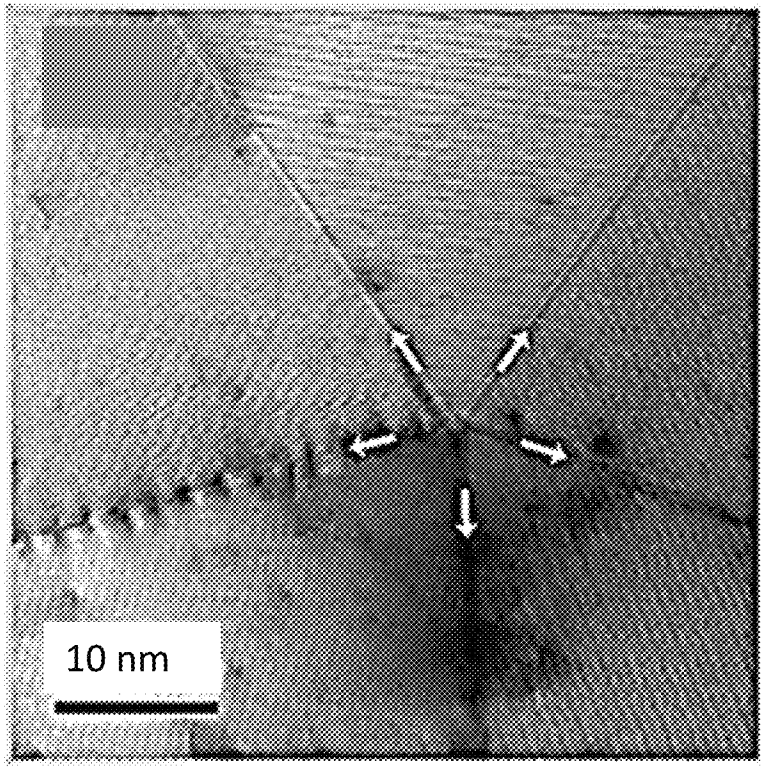
FIG. 4D is a high magnification BF-STEM image showing the five-fold symmetry of the nano-twinning structure (parallel with white arrows), indicative of the cross-section of a nanowire.
Figure 4C:
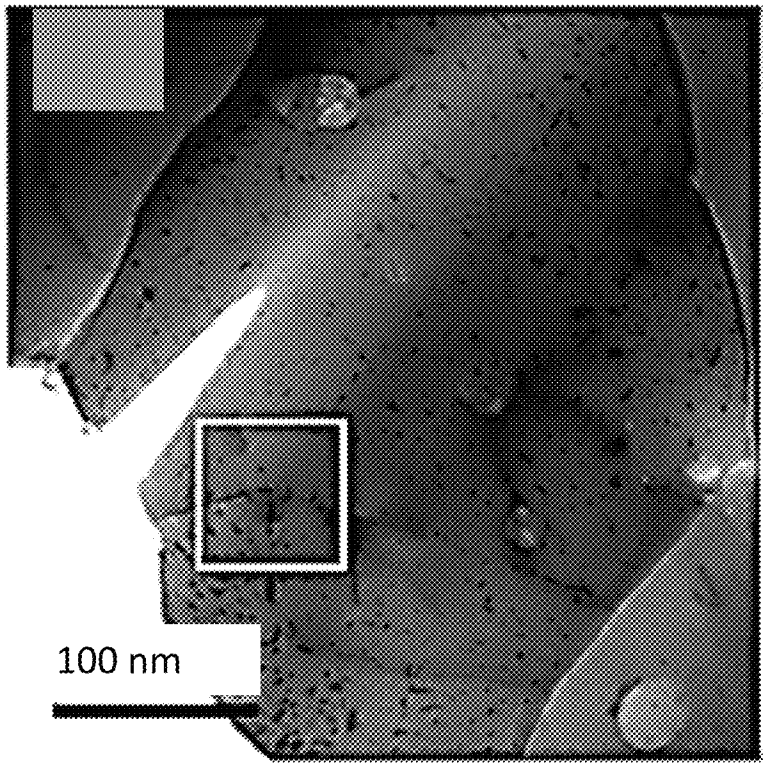
FIG. 4C is a representative BF-STEM image of a thin lamella of the pellet made by FIB cutting, which unexpectedly reveals the presence of a penta-twinned microstructure, a characteristic of the starting silver nanowires.
Figure 4E:
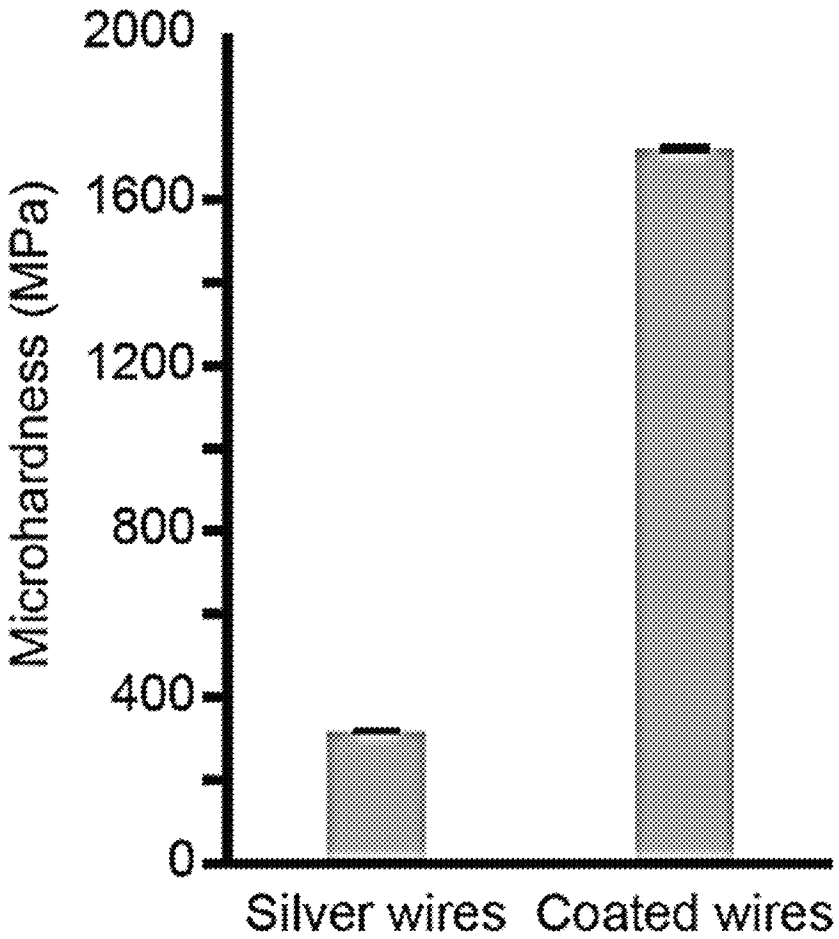
FIG. 4E is a plot of hardness values of hot-pressed samples made from: neat silver nanowires and copper-coated silver nanowires, the latter of which shows the highest value of hardness due to the preservation of nano-twinned microstructures in the densified bulk metal.

Next, the hot-pressed pellet was cut in half using a high-speed rotary saw, mechanically polished, and then milled using the focused ion beam (FIB) technique to expose an undeformed cross-section for microscopy observation. SEM image of the FIB-milled cross-section shows a smooth, dense, and featureless plane, which indicates successful densification in the observed areas (FIG. 4A). After a brief immersion in a nitric acid solution (35%) at 80° C.—which preferentially etches copper—wire-like silver grains are revealed (FIG. 4B). Structural features at the higher spatial resolution shown in FIGS. 4C and 4D demonstrate the retention of five-fold nano-twin structures of the silver nanowire. These microscopy observations clearly show that the hot-pressing step successfully densified the metal. In addition, these images unexpectedly showed that at least some of the wire-like grains and their internal twinning microstructure survived the high temperature and pressure used during densification. FIG. 4D is a magnified image of the box in FIG. 4C; the five outwardly pointing arrows show the preserved internal twinning microstructure. Vickers microhardness (see FIG. 4E) of hot-pressed pellets made of silver nanowires, with and without copper coating, was measured to provide a first assessment of their mechanical properties. The pellet from uncoated nanowires experienced significant sintering and grain growth, consistent with its much lower hardness as compared to the pellet densified from copper-plated silver nanowires. The enhanced thermal stability of silver nanowires by copper coating may be attributed to the ability of copper atoms to segregate to the grain and twin boundaries of silver. Copper coating also inhibits surface diffusion of silver and delays the onset of Plateau-Rayleigh instability. In addition, copper atoms have a higher surface and grain boundary diffusion rate than silver, which improves their ability to fill pores during hot pressing. The results show that the copper coating stabilizes and preserves the fine silver microstructures, resulting in better densification and greater hardness of the final bulk metal.

To elucidate the role of sub-grain strengthening due to the presence of five-fold twinning in the nanowire sample, a control sample was made from silver particles without twins. These particles, with a mean diameter of about 220 nm, were also prepared by the polyol process (albeit under different reaction conditions), and they were also coated with copper, using the same electroless deposition procedure as the nanowires. The copper-coated silver particles were then hot pressed under the same conditions as the nanowire samples. The resulting control pellet densified from untwinned particles was compared to the twinned-nanowire pellet in the following isothermal annealing procedure.

Figure 4F:
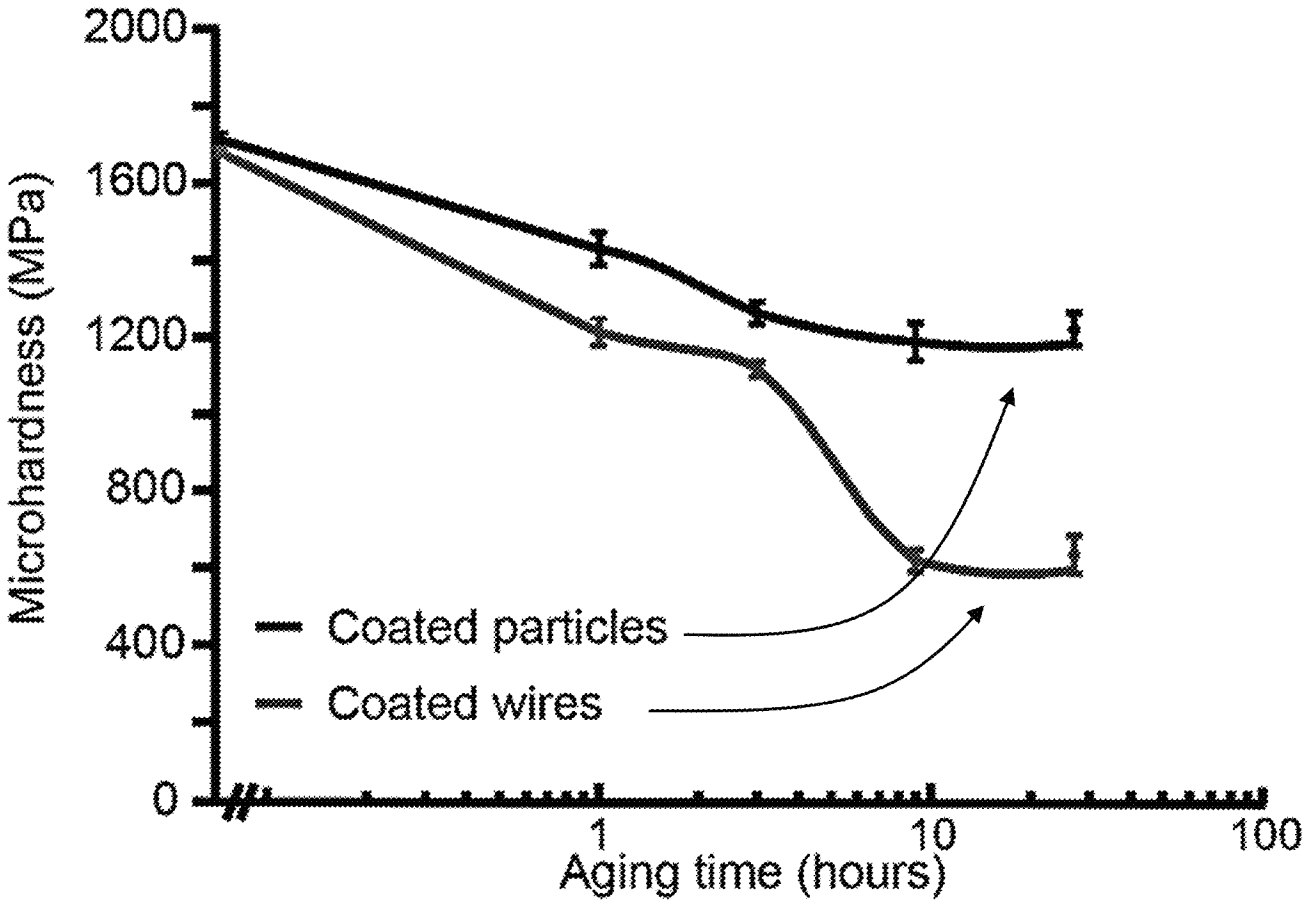
FIG. 4F plots values of sample microhardness during isothermal annealing at 500° C. for bulk silver made from copper coated polyol particles and nanowires. The large drop in hardness between the 3- and 9-hour steps for the nanowire sample is consistent with the removal of the contribution of nano-twined microstructure to strengthening as a result of annealing.

Examining the mechanical properties of a sample at different durations of isothermal annealing helps elucidate how microstructure evolution, such as grain growth or recrystallization, affects its mechanical properties. The microhardness of both samples was measured after aging for 1, 3, 9, and 27 hours at 500° C. (see FIG. 4F). This temperature was selected as it is known to cause grain growth in alloyed copper-silver. As grain growth proceeds, the hardness of the samples gradually decreased, as observed for the control sample (FIG. 4F top line). However, for the nanowire pellet, there was a substantial drop in hardness between 3 and 9 hours of isothermal annealing (FIG. 4F, bottom line). This drop of ~550 MPa is in line with the estimated contribution of twin-boundaries to hardness using a modified form of the Hall-Petch equation (see detailed discussion above).

CONCLUSION

This Example demonstrates the merging of the two branches of metallic nanomaterials research, enabling new microstructures through bottom-up assembly of pre-synthesized nanocrystals with well-defined morphology and microstructure. It was found that an electroless copper coating enhances the thermal stability of silver nanowires, allowing them to be densified by hot-pressing and surprisingly, without eliminating the five-fold twinning microstructure inherited from the starting silver nanowires.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

If not already included, all numeric values of parameters in the present disclosure are proceeded by the term "about" which means approximately. This encompasses those variations inherent to the measurement of the relevant parameter as understood by those of ordinary skill in the art. This also encompasses the exact value of the disclosed numeric value and values that round to the disclosed numeric value.

The foregoing description of illustrative embodiments of the disclosure has been presented for purposes of illustration and of description. It is not intended to be exhaustive or to limit the disclosure to the precise form disclosed, and modifications and variations are possible in light of the above teachings or may be acquired from practice of the disclosure. The embodiments were chosen and described in order to explain the principles of the disclosure and as practical applications of the invention to enable one skilled in the art to utilize the disclosure in various embodiments and with various modifications as suited to the particular use contemplated. It is intended that the scope of the disclosure be defined by the claims appended hereto and their equivalents.

What is claimed is:

1. A method of forming a bulk nanostructured metal alloy, the method comprising applying pressure to a collection of coated metal nanocrystals while heating, wherein the coated metal nanocrystals comprise metal nanocrystals comprising a metal and characterized by at least one twinning boundary therein, and a coating of a different metal on surfaces of the metal nanocrystals, and wherein the bulk nanostructured metal alloy comprises the metal of the metal nanocrystals and the different metal of the coating, the bulk nanostructured metal alloy characterized by the at least one twinning boundary therein, wherein the metal of the metal nanocrystals is selected from silver, copper, iron, and combinations thereof; and the different metal of the coating is selected from copper, nickel, silver, cobalt, and combinations thereof.

2. The method of claim 1, wherein the bulk nanostructured metal alloy further comprises one or more metal nanocrystals embedded therein, the one or more metal nanocrystals derived from the coated metal nanocrystals.

3. The method of claim 1, wherein the metal of the metal nanocrystals is silver and the different metal of the coating is copper or the metal of the metal nanocrystals is copper and the different metal of the coating is silver.

4. The method of claim 1, wherein the metal nanocrystals consist of silver nanowires and the coating consists of copper.

5. The method of claim 4, wherein the copper is present at an amount in a range of from 0.2 weight % to 15 weight % as compared to a total weight of the copper and the silver nanowires.

6. A method of forming a bulk nanostructured metal alloy, the method comprising applying pressure to a collection of coated metal nanocrystals while heating, wherein the coated metal nanocrystals comprise metal nanocrystals comprising a metal and characterized by at least one twinning boundary therein, and a coating of a different metal on surfaces of the metal nanocrystals, and wherein the bulk nanostructured metal alloy comprises the metal of the metal nanocrystals and the different metal of the coating, the bulk nanostructured metal alloy characterized by the at least one twinning boundary therein, wherein the pressure is from 40 MPa to 1000 MPa and the heating uses a temperature from greater than room temperature to no more than 50% of the different metal's melting temperature.

7. The method of claim 3, wherein the bulk nanostructured metal alloy has a microhardness of at least 1200 MPa.

8. The method of claim 1, wherein the nanocrystals of the metal nanocrystals are nanowires, nanoplatelets, or combinations thereof.

9. The method of claim 1, wherein the nanocrystals of the metal nanocrystals are nanowires.

10. The method of claim 1, wherein the metal of the metal nanocrystals is silver and the different metal of the coating is copper; the metal of the metal nanocrystals is silver and the different metal of the coating is nickel; the metal of the metal nanocrystals is copper and the different metal of the coating is silver; the metal of the metal nanocrystals is copper and the different metal of the coating is cobalt; or the metal of the metal nanocrystals is iron and the different metal of the coating is copper.

* * * * *